United States Patent [19]

Marjollet et al.

[11] Patent Number: 5,025,630

[45] Date of Patent: Jun. 25, 1991

[54] METHOD AND DEVICE FOR PROTECTING AGAINST EROSION AND/OR CORROSION STEAM PIPES FROM THE HIGH-PRESSURE STAGE OF A TURBINE

[75] Inventors: Jacques Marjollet; Boris Perras, both of Paris, France

[73] Assignee: Stein Industrie, France

[21] Appl. No.: 460,793

[22] Filed: Jan. 4, 1990

[30] Foreign Application Priority Data

Jan. 6, 1989 [FR] France ..... 89 00110

[51] Int. Cl.[5] ..... F01K 21/00

[52] U.S. Cl. ..... 60/646; 60/657; 60/679

[58] Field of Search ..... 60/646, 657, 679

[56] References Cited

U.S. PATENT DOCUMENTS

| | | | |
|---|---|---|---|
| 4,237,691 | 12/1980 | Bodmer | 60/646 |
| 4,298,019 | 11/1981 | Daransky et al. | 60/679 X |
| 4,471,618 | 9/1984 | Tratz et al. | 60/646 |
| 4,510,755 | 4/1985 | Gartmann et al. | 60/679 X |

FOREIGN PATENT DOCUMENTS 2312725 9/1974 Fed. Rep. of Germany .

*Primary Examiner*—Allen M. Ostrager

*Attorney, Agent, or Firm*—Sughrue, Mion, Zinn, Macpeak & Seas

[57] ABSTRACT

In a method and device for protecting against erosion and/or corrosion steam pipes of the high-pressure stage of a power and/or steam generation plant saturated steam turbine, at portions of its low-pressure stage and at heaters of the heat exchanger installation of the power and/or steam generation plant, the major part of the water contained in the offtakes and the wet steam outlets of the high-pressure stage is separated out by centrifugal means. A first fraction of the steam partly dried by this means is superheated and/or final dried and then fed into the portions of the low-pressure stage of the turbine and a complementary fraction of the partly dried steam is fed to the heaters. The first fraction and the complementary fraction of the steam are dried together by centrifugal means after which the complementary fraction is final dried by centrifugal means.

6 Claims, 5 Drawing Sheets

METHOD AND DEVICE FOR PROTECTING AGAINST EROSION AND/OR CORROSION STEAM PIPES FROM THE HIGH-PRESSURE STAGE OF A TURBINE

BACKGROUND OF THE INVENTION

1. Field of the invention

The present invention concerns a method of protecting against erosion and/or corrosion steam pipes of the high-pressure stage of a power and/or steam generation plant saturated steam turbine, at its low-pressure stage and at heaters of the heat exchanger installation of the power and/or steam generation plant, in which method the major part of the water contained in the wet steam outlets and offtakes of the high-pressure stage is separated out by centrifugal means, a first fraction of the steam partly dried by this means is superheated and/or final dried and then fed into the low pressure stage of the turbine and a complementary fraction of the partly dried steam is fed to the heaters. It also encompasses a device for implementing this method.

As is known, the steam from the offtakes or the outlet of the high-pressure stage of a saturated steam turbine is wet (water content approximately 10 to 20%). Because it flows at relatively high speed in the steam pipes, either to the low-pressure stage of the turbine or to the steam heaters of the heat exchanger installation of the power and/or steam generation plant, the water particles in motion cause relative rapid erosion and/or corrosion of the pipes.

It has already been proposed to reduce the water content of this steam to a sufficiently low value for it to produce no significant erosion and/or corrosion of the pipes. Use may be made for this purpose of high-speed centrifugal separators with coaxial tubular members supplying at the downstream end a coaxial flow of steam with reduced water content and a peripheral flow of water or of steam with a very much increased water content, of the kind described in particular in the documents EP-A-0002235, EP-A-0005493 and FR-A-2558741.

In this way the moisture content of the steam entering the downstream pipework can be reduced to less than 1%. Downstream of the low-pressure stage the steam is superheated and/or dried more thoroughly at the entry to the low-pressure stage of the steam turbine by means of superheaters comprising tubular heat exchangers with bundles of tubes through which the water vapor at higher temperature and at higher pressure passes and/or separators comprising bundles of parallel corrugated plates, the separator-superheaters being either vertical, of the kind described in the document EP-A-0010261, or horizontal, of the kind described in the document EP-A-0005225, for example.

FIG. 1 of the appended drawings is a schematic representation of a protection device of this kind.

The high-pressure portion 1 of the steam expansion turbine is on the same shaft 1A as its low-pressure portions 34, 36, 38. The high-pressure portion comprises two series of wet steam outlets 2, 4 and 3, 5 adapted to be connected to the low-pressure portions by main pipes 20 and 21. Offtakes 6 and 7 are provided to feed respective heaters 22A and 23A of the heat exchanger installation of the power and/or steam generation plant, for example to heat the water supplied to the power and/or steam generation plant. The offtake pipes incorporate respective high-speed centrifugal separators 8, 10, 12 and 9, 11, 13.

Downstream of the high-speed centrifugal separators the pipes 14, 16 and 15, 17 discharge into the main pipes 20 and 21 to the low-pressure stage. The pipes 18 and 19 feed the steam to the heaters 22A and 23A previously mentioned.

The main pipes 20 and 21 feed the three low-pressure portions of the turbine. They are divided between pipes 22, 24, 26 and 23, 25, 27 incorporating separator-superheaters 28, 30, 32 and 29, 31, 33. The various streams of superheated and/or dried steam then discharge into the low-pressure portions 34, 36, 38.

This device makes it possible to prevent most erosion and/or corrosion of the feed pipes of the low-pressure expansion portions and heaters but requires the installation of a high-speed separator on each steam pipe. The necessary plant is therefore somewhat complex and costly.

An object of the invention is to provide a method and a device for protecting against erosion and/or corrosion steam outlet and offtake pipes from the high-pressure stage of the turbine and the pipes connecting to the low-pressure stage portions and to the heaters of the heat exchanger installation of the power and/or steam generation plant necessitating simpler and less costly plant for equally effective drying of the steam drawn off from the high-pressure stage.

SUMMARY OF THE INVENTION

In one aspect, the invention consists in a method of protecting against erosion and/or corrosion steam pipes of the high-pressure stage of a power and/or steam generation plant saturated steam turbine, at portions of its low-pressure stage and at heaters of the heat exchanger installation of the power and/or steam generation plant, in which method the major part of the water contained in the wet steam outlets and the offtakes of the high-pressure stage is separated out by centrifugal means, a first fraction of the steam partly dried by this means is superheated and/or final dried and then fed into the portions of the low-pressure stage of the turbine and a complementary fraction of the partly dried steam is fed to the heaters, the first fraction and the complementary fraction of the steam being dried together by centrifugal means after which the complementary fraction is final dried by centrigual means.

In one embodiment, the complementary fraction of the steam to be sent to the heaters is taken off from the steam offtake outlets of the centrifugal separation means processing all the wet steam from the high-pressure stage of the turbine and then final dried by centrifugal means. In another, more advantageous embodiment the complementary fraction of the steam to be sent to the heaters is final dried and then taken off from the wet steam offtake outlets of centrifugal separation means processing all the steam from the high-pressure stage of the turbine.

In another aspect, the invention consists in a device for protecting against erosion and/or corrosion steam pipes of the high-pressure stage of the power and/or steam generation plant saturated steam turbine, at portions of its low-pressure stage and at heaters of the heat exchanger installation of the power and/or steam generation plant, comprising centrifugal means for separating out the major part of the water contained in the offtakes and wet steam outlets of the high-pressure stage, pipes for conveying steam partly dried in the centrifugal separation means to the heaters, common pipes for conveying steam dried in the separation means to the low-pressure stage of the turbine, and superheaters and/or separators on pipes for feeding steam from the common pipes to the low-pressure stage, wherein the centrifugal separation means for the steam to be passed to the low-pressure stage are divided between groups of at least two steam offtake pipes and connected to exhausts for the steam to be passed to the heaters and the pipes for conveying the dried steam to the heaters are connected to outlets of the centrifugal separation means.

In one embodiment the pipes for conveying steam to the heaters are connected to wet steam offtake outlets of the centrifugal separation means and provided with auxiliary centrifugal separation means.

In a preferred second embodiment the pipes for conveying steam to the heaters are connected to dried steam offtake outlets of the centrifugal separation means and do not comprise separate auxiliary centrifugal separation means. The plant needed for drying the steam is therefore further reduced.

Devices representing the above-mentioned two embodiments of the invention are described hereinafter by way of example and with reference to FIGS. 2 through 5 of the appended drawings.

DETAILED DESCRIPTION OF THE INVENTION

Figure 2:
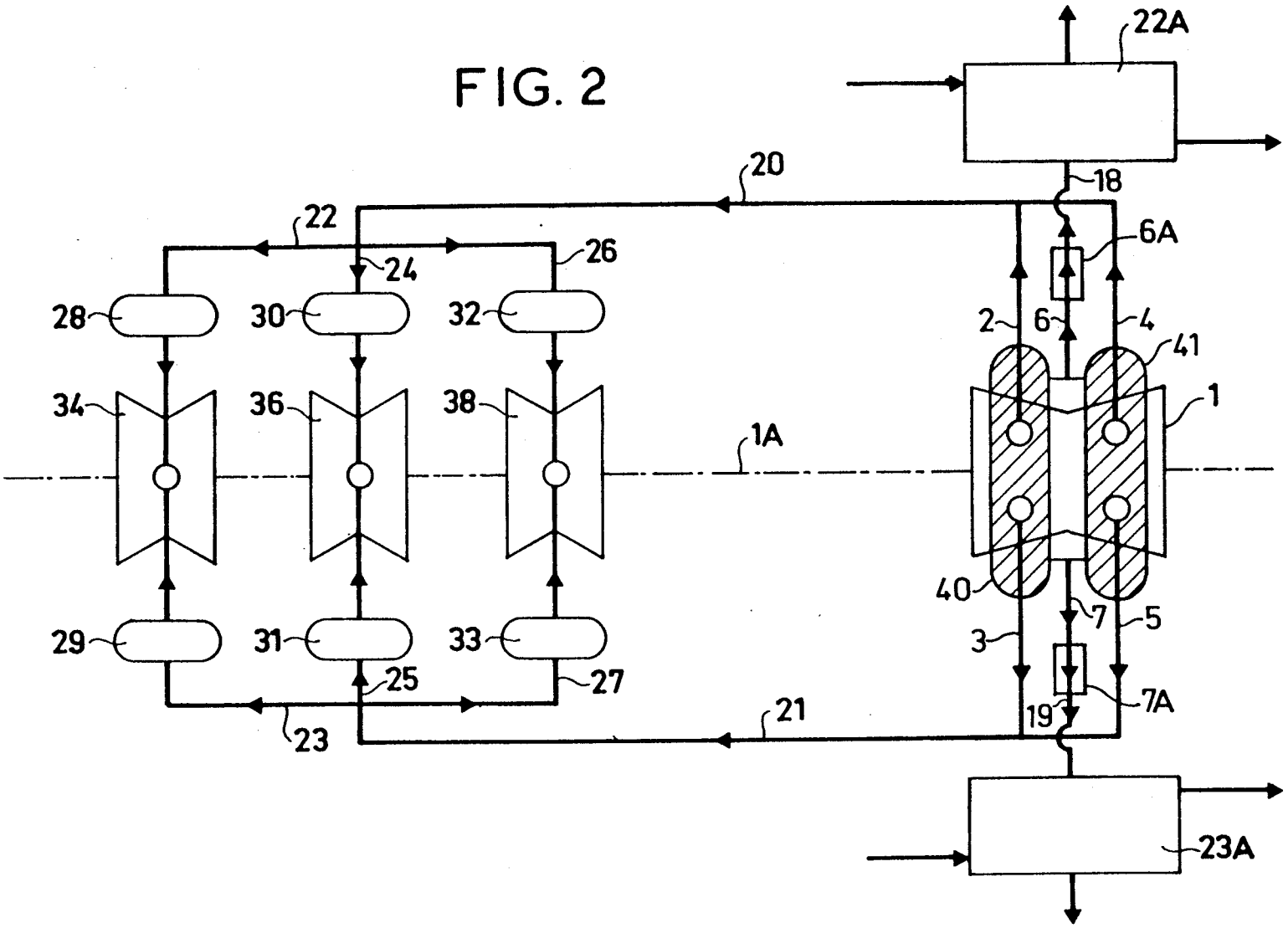
FIG. 2 shows a first embodiment of the device incorporating auxiliary centrifugal separators on the steam heater feed pipes.

In FIG. 2, the high-speed centrifugal separators 40 and 41 receive respectively the exhausts from the high-pressure portion 1 of the turbine corresponding to the offtake and steam outlet pipes 2, 4, 6 and 3, 5, 7. Wet steam is drawn off from the sides of these separators and fed by the pipes 6 and 7 to auxiliary high-speed separators 6A and 7A to be dried there as described in "Moisture separation helps eliminate erosion-corrosion", Nuclear Engineering International, March 1988, pages 43–44, and then from the latter by the pipes 18 and 19 to the steam heaters 22A and 23A.

Figure 1:
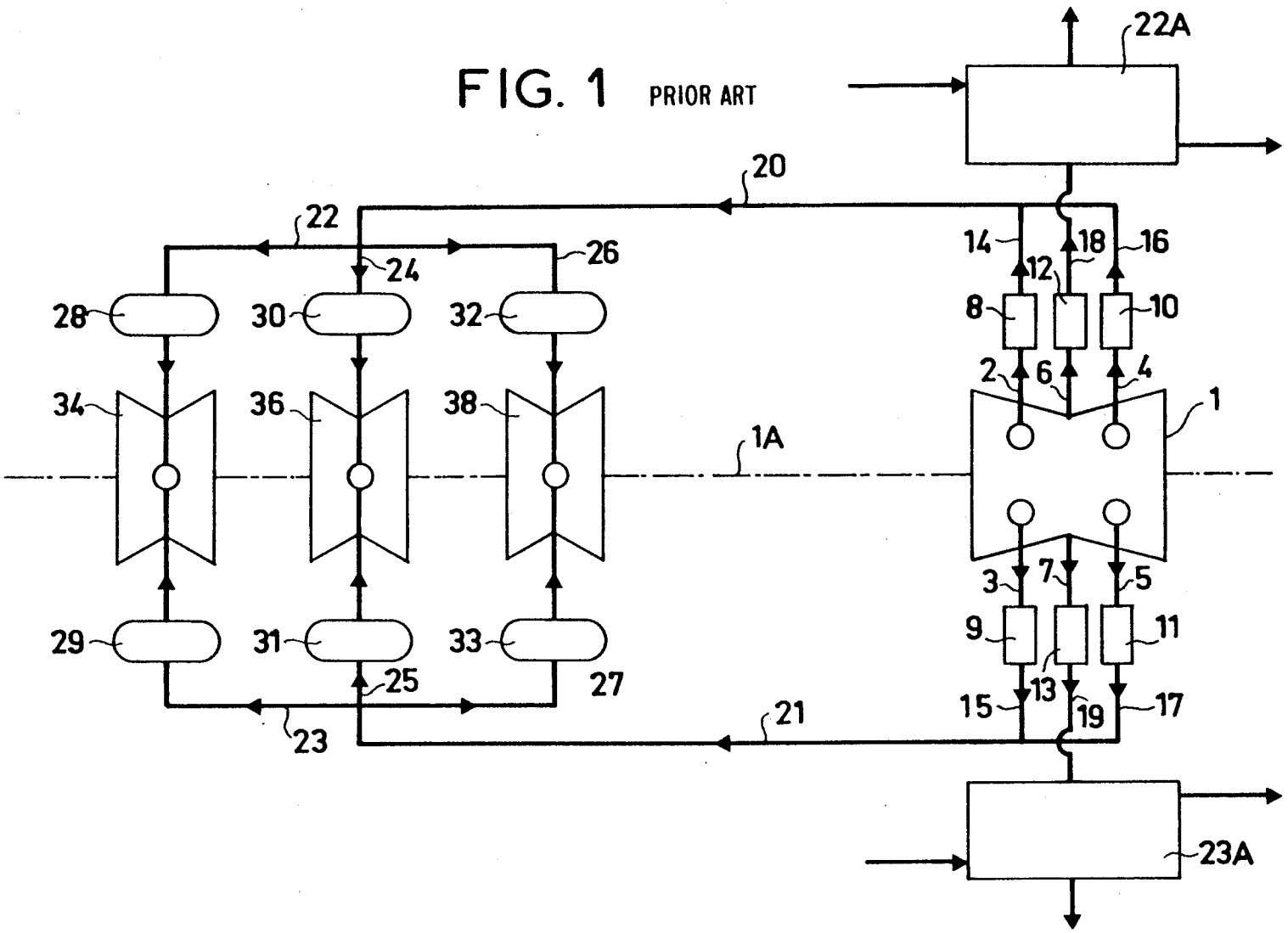
FIG. 1 PRIOR ART
FIG. 1 shows a prior art installation.

As in the device shown in FIG. 1, the steam dried in the separators 40, 41 is fed by the main pipes 20, 21 to the superheater separators 28, 30, 32 and 29, 31, 33 and then to the low-pressure portions 34, 36, 38 of the turbine.

Figure 3:
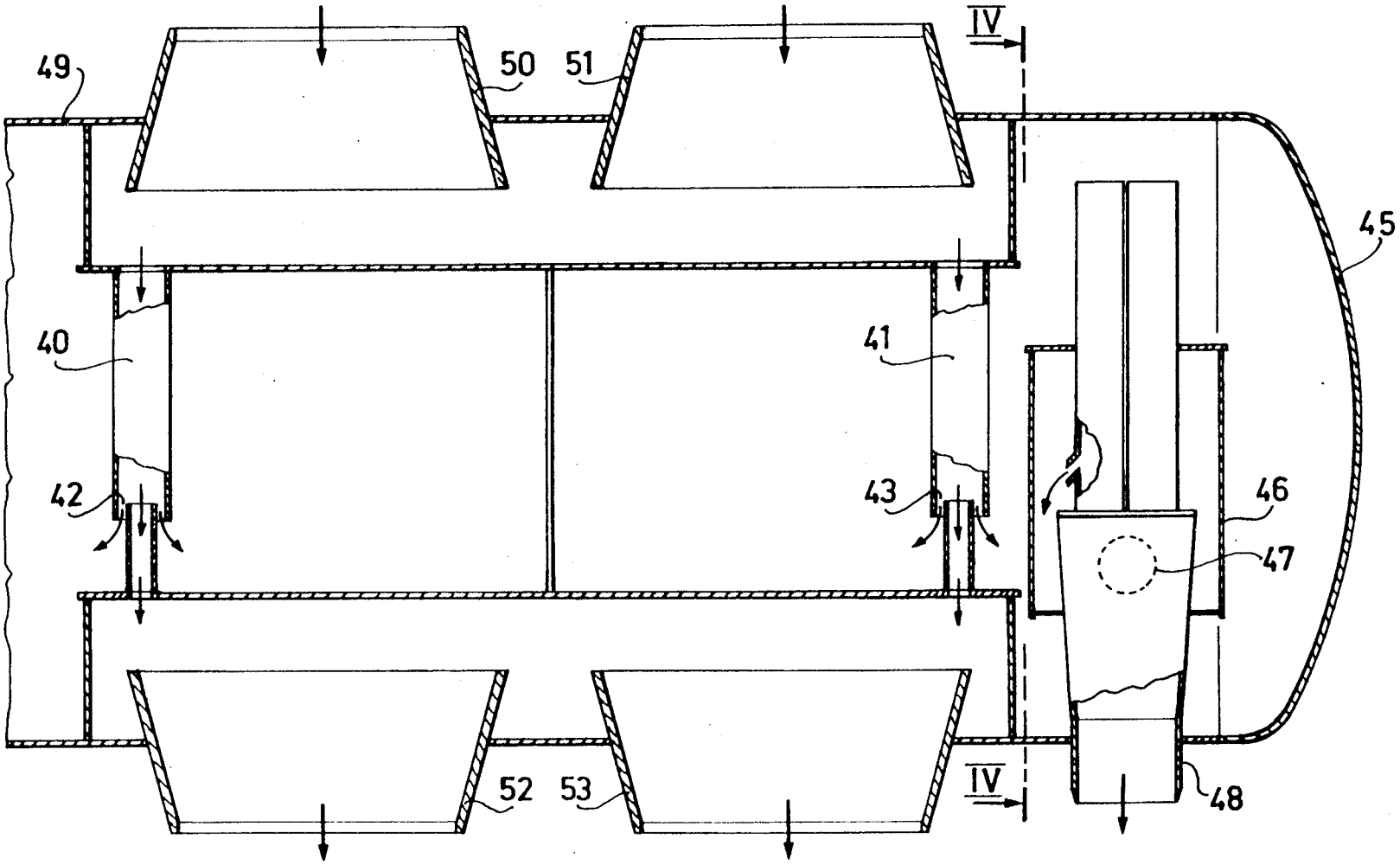
FIG. 3 shows in more detail and in vertical cross-section the centrifugal separators of the device from FIG. 5 with their connections.
Figure 4:
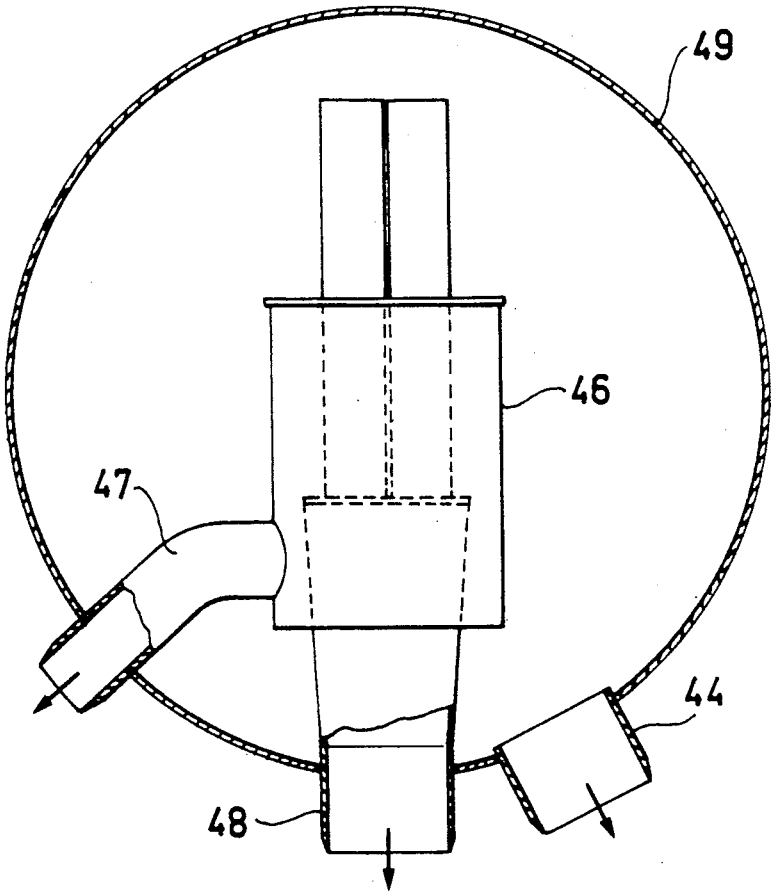
FIG. 4 shows a cross-section in a plane perpendicular to that of FIG. 3 on the line IV-IV in FIG. 3.

In FIGS. 3 and 4 the wet steam Qp+Qs from the high-pressure stage of the turbine passes to the water separation stage contained in a horizontal axis cylindrical tank 49 via mountings 50, 51 on its upper generatrix. On the same axes as the mountings, but on the lower generatrix of the tank, are dry steam outlet mountings 52, 53.

On the common axes of the mountings 50, 52 and 51, 53 inside the tank are two groups 40, 41 of cylindrical centrifugal separation cells which process the flow of steam to be dried from the two circuits.

For these cells to operate efficiently a certain quantity Qs of wet steam is taken off with the water separated out in the cells 40, 41 at the level of the circular lips 42, 43 of the tubes of the cells 40, 41. The water separated out in the cells 40, 41 flows downwards inside the jacket 45 towards a purge offtake pipe 44 (FIG. 4). A quantity Qs of wet steam flows upwards inside the same jacket 45 around groups of auxiliary centrifugal separation cells of which only the group 46 connected to the group of main separation cells 41 is shown. The wet steam then enters this group of auxiliary cells. The water separated out in the cells 46 is drained off via the pipe 47. The dried steam leaves through the pipe 48 and is fed to the steam heaters.

The steam Qp dried in the main groups of separation cells 40, 41 is fed by the outlet mountings 52, 53 to the low-pressure portions of the expansion turbine.

Figure 5:
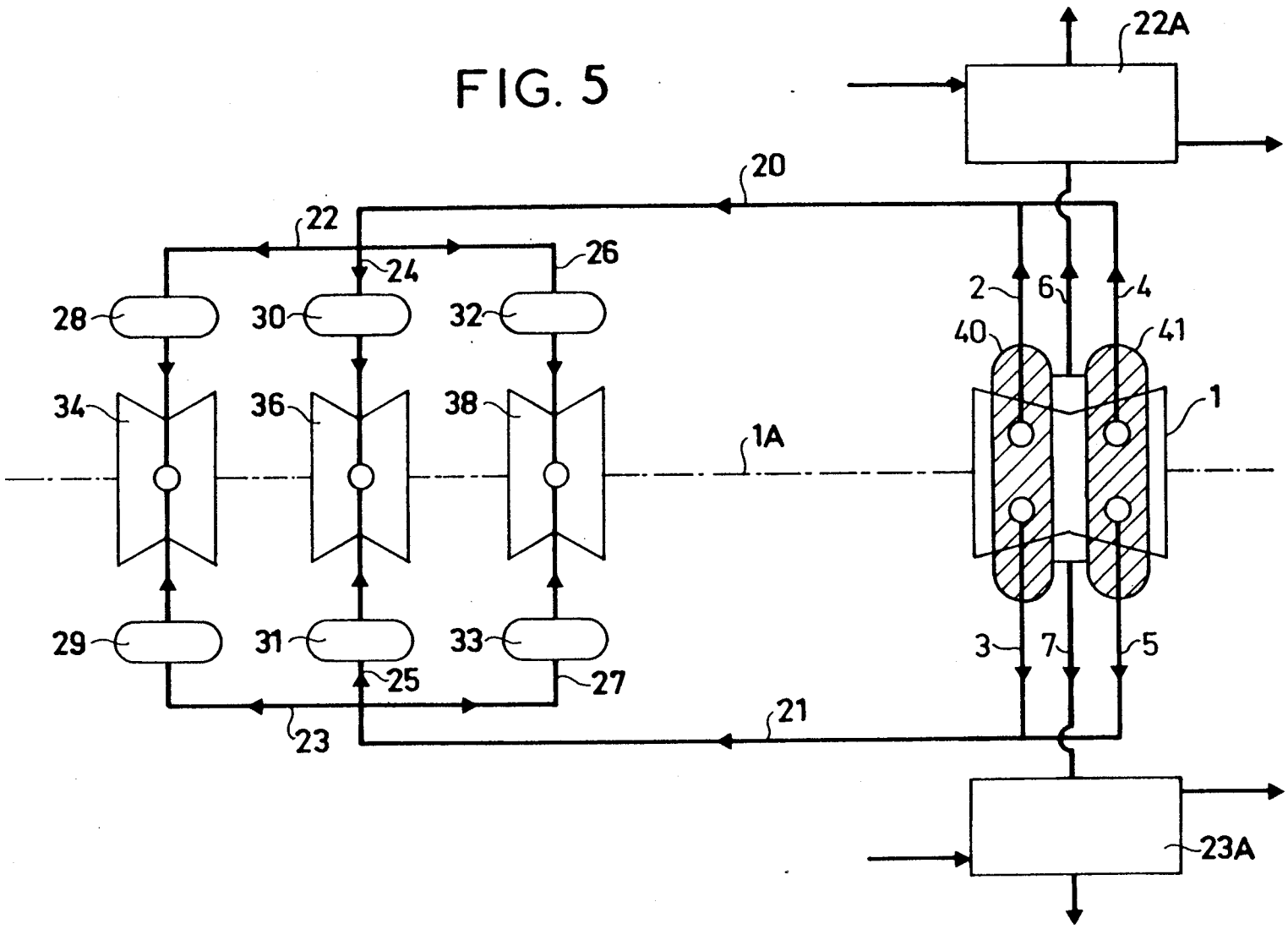
FIG. 5 shows the preferred embodiment of the device in which the heater feed pipes receive steam already dried in the main high-speed separator disposed on the turbine low-pressure portion feed pipes.

The device shown in FIG. 5 is broadly similar to that of FIG. 2 and component parts common to the latter will not be described again. However, the drawn off steam feeding the steam heaters 22A and 23A through the steam circuits 6 and 7 is dried within separators 40 and 41 identical to those previously described and shown in FIGS. 3 and 4, rather than in auxiliary separators.

This device is therefore simpler in that it comprises only two groups of high-speed centrifugal separation cells for all the steam pipes leading from the high-pressure stage of the turbine.

There is claimed:

1. Method of protecting against erosion and/or corrosion steam pipes of the high-pressure stage of a power and/or steam generation plant saturated steam turbine, at portions of its low-pressure stage and at heaters of the heat exchanger installation of the power and/or steam generation plant, in which method the major part of the water contained in the offtakes and the wet steam outlets of the high-pressure stage is separated out by centrifugal means, a first fraction of the steam partly dried by said centrifugal means is at least final dried (28 30, 32, 29, 31, 33) and then fed into the portions of the low-pressure stage of the turbine and a complementary fraction of the partly dried steam is fed to the heaters (22A, 23A), the first fraction and the complementary fraction of the steam being partially dried together by centrifugal means (40, 41) after which the complementary fraction is final dried by centrifugal means.

2. Method according to claim 1 wherein said complementary fraction of the steam to be sent to said heaters is taken off from the steam offtake outlet of the centrifugal separation means processing all the wet steam from said high-pressure stage of said turbine and then final dried by centrifugal means.

3. Method according to claim 1 wherein said complementary fraction of the steam to be sent to said heaters is final dried and then taken off from the wet steam offtake outlets of centrifugal separation means processing all the steam from said high-pressure stage of said turbine.

4. Device for protecting against erosion and/or corrosion steam pipes of the high-pressure stage of a power and/or steam generation plant saturated steam turbine, at portions of its low-pressure stage and at heaters of the heat exchanger installation of the power and/or steam generation plant, comprising centrifugal means for separating out the major part of the water contained in the wet steam outlets and offtakes of the high-pressure stage, pipes for conveying steam partly dried in the centrifugal separation means to the heaters, common pipes for conveying steam dried in the separation means to the low-pressure stage of the turbine, and superheaters and/or separators on pipes for feeding steam from the common pipes to the low-pressure stage, wherein said centrifugal separation means are provided with common inlets for all of the steam from the high-pressure stage, and with first outlets for the steam to be passed to the low-pressure stage and second outlets for the steam to be passed to the reheaters.

5. Device according to claim 4 wherein said pipes (6, 7) conveying steam to said heaters are connected to wet steam offtake outlets of said centrifugal separation means and provided with auxiliary centrifugal separation means.

6. Device according to claim 4 wherein said pipes (6, 7) conveying steam to said heaters (22A, 23A) connect directly the dried steam offtake outlets of said centrifugal separation means (40, 41) to said reheaters.

* * * * *